United States Patent [19]

Wagner

[11] 4,094,341

[45] June 13, 1978

[54] LOOM PICKER CONSTRUCTION

[75] Inventor: William T. Wagner, Dayton, Ohio

[73] Assignee: Dayco Corporation, Dayton, Ohio

[21] Appl. No.: 809,131

[22] Filed: Jun. 22, 1977

[51] Int. Cl.[2] ..... D03D 49/36

[52] U.S. Cl. ..... 139/159

[58] Field of Search ..... 139/159, 160

[56] References Cited

U.S. PATENT DOCUMENTS

| | | | |
|---|---|---|---|
| 851,250 | 4/1907 | Pilling | 139/159 |
| 2,222,351 | 11/1940 | Lewis | 139/159 |
| 2,222,352 | 11/1940 | Lewis | 139/159 |
| 2,222,353 | 11/1940 | Lewis | 139/159 |
| 2,728,360 | 12/1955 | Hargreaves | 139/159 |
| 2,740,431 | 4/1956 | Hargreaves | 139/159 |

*Primary Examiner*—James Kee Chi

*Attorney, Agent, or Firm*—Reuben Wolk

[57] ABSTRACT

In a loom picker construction having a picker stick, shuttle-engaging block, and apparatus for holding the block on the stick, an improvement in the holding apparatus is provided and includes a pair of projections extending from opposite sides of the block, and a spring clamp engaging the projections and stick and yieldingly urging the block against the stick.

18 Claims, 5 Drawing Figures

LOOM PICKER CONSTRUCTION

BACKGROUND OF THE INVENTION

Loom picker constructions or loom pickers are widely used in the textile industry for well known purposes which will not be discussed herein. Each of these loom pickers has what is referred to as a picker stick on which is mounted a shuttle-engaging block, and, various means and techniques have been proposed heretofore for fastening a block on its picker stick. However, the nature of the service required of a loom picker is such that there is rapid deterioration of the means holding the shuttle-engaging block on its picker stick which is often followed by deterioration of both the block and stick. The holding means proposed heretofore have deficiencies of being either too complicated and expensive or not capable of providing a satisfactory holding function.

SUMMARY

It is a feature of this invention to provide a loom picker construction having improved means for holding a shuttle-engaging block thereof on an associated picker stick wherein such holding means overcomes the above-mentioned deficiencies.

Another feature of this invention is to provide holding means of the character mentioned which enables easy installation of an associated shuttle-engaging block on an associated picker stick with optimum simplicity.

Another feature of this invention is to provide holding means of the character mentioned which is free of projections likely to have yarn entangled therearound during operation of its loom picker construction.

Another feature of this invention is to provide improved holding means for a loom picker construction made from a single piece of spring wire made in an endless configuration.

Another feature of this invention is to provide in a loom picker construction having a picker stick, shuttle-engaging block, and apparatus for holding the said block on the stick, an improvement in the holding apparatus including a pair of projections extending from opposite sides of the block, and a spring clamp engaging the projections and stick and yieldingly urging the block against the stick.

Accordingly, it is an object of this invention to provide a loom picker construction having one or more of the novel features set forth above or hereinafter shown or described.

Other details, features, objects, uses, and advantages of this invention will become apparent from the embodiment thereof prepared in the following specification, claims, and drawing.

BRIEF DESCRIPTION OF THE DRAWING

The accompanying drawing shows a present preferred embodiment of this invention, in which.

DESCRIPTION OF ILLUSTRATED EMBODIMENT

Figure 1:
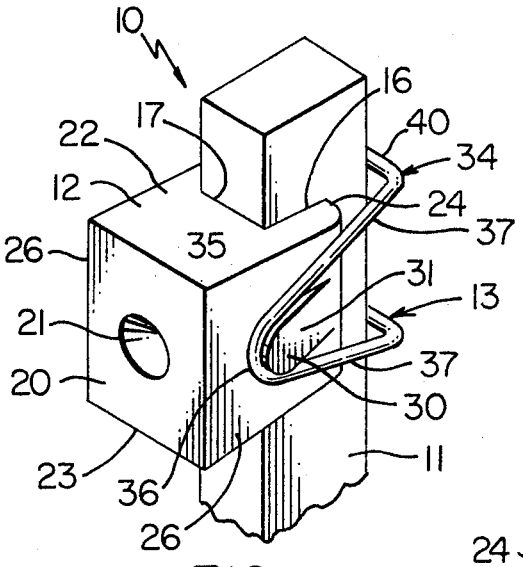
FIG. 1 is a fragmentary perspective view illustrating one exemplary embodiment of the loom picker construction of this invention.

Reference is now made to FIG. 1 of the drawing which illustrates one exemplary embodiment of a loom picker construction of this invention which is designated generally by the reference numeral 10. The loom picker construction has a picker stick 11, a shuttle-engaging block 12, and an improved means 13 for holding the block 12 on the stick 11 and such holding means 13 will be described in detail subsequently.

Figure 2:
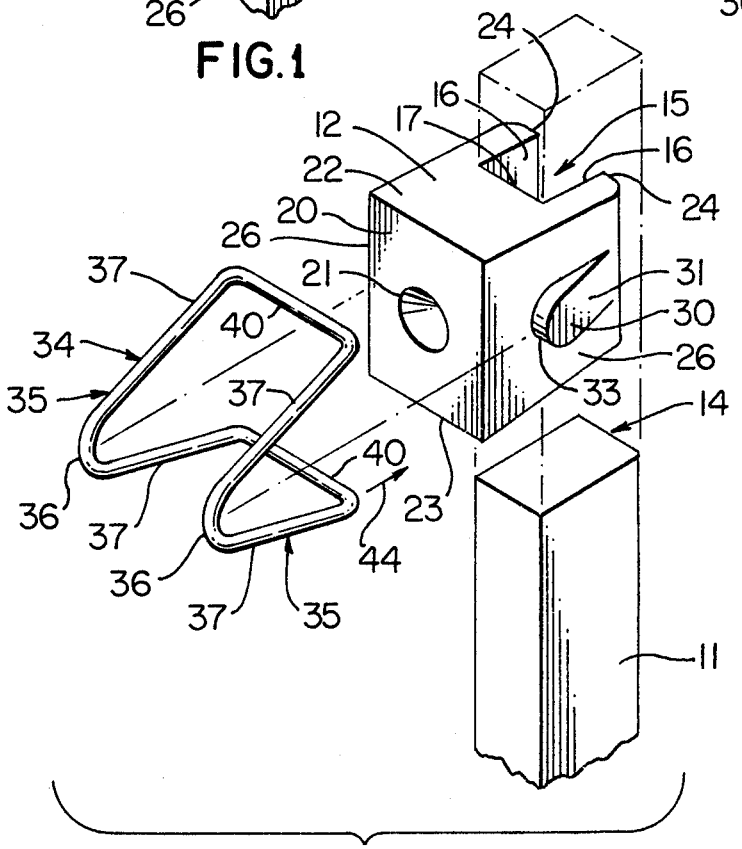
FIG. 2 is an exploded perspective view of the components of the picker construction of FIG. 1, illustrating an initial step of installing a shuttle-engaging block on a picker stick utilizing a spring clamp in accordance with this invention.
Figure 4:
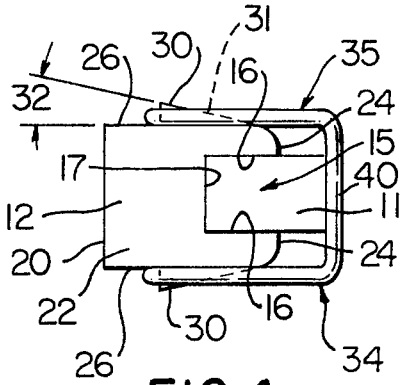
FIG. 4 is a top plan view of the loom picker construction as illustrated in FIG. 1.

The picker stick 11 may be made of any suitable material known in the art and may be of any suitable configuration; and, in this example of the invention the picker stick 11 is an elongated stick having a rectangular cross-sectional configuration and as will be readily apparent at 14 in FIG. 2.

The shuttle-engaging block 12 may be of any suitable configuration and construction known in the art; and, block 12 is provided for a purpose which is well known in the textile industry. The block 12 has a U-shaped channel 15 extending along the full vertical height thereof and such channel is defined by a pair of parallel spaced apart planar sides 16 interconnected at their innermost or lower edges by a planar surface 17. As will be readily apparent from FIGS. 1–4 of the drawing the picker stick 11 is adapted to be received within the groove 15 and the holding means 13 of this invention is employed to hold such block 12 on the stick 11.

The block 12 has what will be referred to as a front face 20 which has the usual conical recess 21 extending inwardly therein from the front face 20 for the well known purpose of receiving the point of a shuttle employed on apparatus (not shown) on which the loom picker construction 10 is employed. The block 12 also has what will be referred to as a top surface 22 and bottom surface 23 (FIG. 5), and the surfaces 22 and 23 converge rearwardly from the front face 20 to the rear of such block defined by a pair of spaced apart rear surfaces 24, FIG. 4.

As seen in FIG. 2, the block 12 has a pair of sides each defined by a planar side surface and each planar side surface will be designated by the same reference numeral 26. The sides 26 are disposed in parallel relation perpendicular to the front face 20.

The holding means 13 of this invention comprises a pair of projections in the form of projecting ears 30 extending from opposite sides of the block 12 and each ear 30 extends outwardly of an associated planar surface or side 26. Each ear 30 has a planar outside surface 31 which is disposed at an angle 32 (FIG. 4) with its associated side surface 26 so that the outside surface 31 of each ear 30 converges smoothly with its surface 26 toward the rear of the block 12. It will also be seen that each ear 30 has a substantially semicylindrical surface 33 defining the forward portion thereof, i.e., forward portion meaning that portion more closely adjacent to front face 20, and each semicylindrical surface 33 is provided for a purpose to be described subsequently.

The holding means 13 of this invention also comprises a spring clamp which is designated generally by the reference numeral 34 and such spring clamp is best illustrated in FIG. 2. The spring clamp 34 of the holding means 13 comprises a pair of roughly V-shaped wire portions 35 each defined by an arcuate or substantially semicircular bight 36 and a pair of diverging legs each designated by the same reference numeral 37. Each roughly V-shaped portion 35 is disposed with its bight and legs in a common plane to define a pair of parallel planes and with the pair of planes associated with the V-shaped portions being disposed in spaced approximately parallel relation and with V-shaped portions 35 symmetrically arranged.

The V-shaped portions 35 have extension means extending from the terminal ends of each pair of associated diverging legs 37; and, in this example such extension means comprises an element 40 interconnecting the terminal ends of associated legs of the V-shaped portions 35. The interconnecting elements 40 are disposed in parallel relation and the spring clamp 34 is defined as a single-piece structure made in an endless configuration.

The single-piece spring clamp 34 may be made of any suitable spring material known in the art including either metallic or non-metallic material; and, such spring clamp is preferably made of a metal wire which has a circular cross-sectional configuration. However, it will be appreciated that the wire employed to make the spring clamp 34 may have any desired non-circular cross-sectional configuration. Once made in its endless configuration the spring clamp 34 has an overall saddle-like appearance.

The spring clamp 34 has a dimension 42 (FIG. 5) measured from the ends of a bight 36 perpendicular to an interconnecting element 40 which is greater, and with the legs 37 of the V-shaped portions 35 compressed in parallel relation, than a similar dimension 43 with the legs 37 of the V-shaped portions 35 released or only partially compressed and with clamp 34 holding block 12 on its stick 11. With this construction it will be appreciated that it is a simple matter to move the spring clamp 34 oriented as shown in FIG. 2 over the block 12 and as indicated by the arrow 44. The elements 40 are then compressed toward each other utilizing any suitable manual or mechanical means and as indicated by the force arrows 45 in FIG. 3. The block 12, and spring clamp 34, can then be slid downwardly along the picker stick 11 essentially as shown by the arrow 46 in FIG. 3; and, once the block 12 is at the desired position the interconnecting elements 40 are released whereby the resilient character of the V-shaped portions 35 causes the legs 37 of such V-shaped portions to move away from the parallel position thereof illustrated at 39 in FIG. 3 to thereby clamp block 12 against stick 11.

Figure 5:
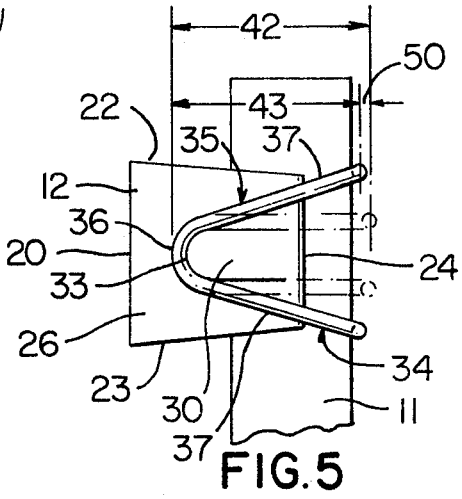
FIG. 5 is a side view of the loom picker construction of FIG. 1 and illustrating by dotted lines the position of the spring clamp as compressed in FIG. 3.

With the interconnecting elements 40 compressed in substantially parallel relation it will be seen that there is adequate space as indicated at 50 in FIG. 5 between the distances 42 and 43 whereby the block 12 may be easily slid downwardly along its picker stick 11. Once the block is in the desired position the V-shaped portions 35 of spring clamp 34 are released allowing the spring clamp 34 to clamp the block 12 in position.

It will be appreciated that the construction and cooperating dimensioning of the spring clamp 34, block 12, and stick 11 in each instance is such that the spring clamp 34 may be easily slid into position around the block 12. For example, the dimensioning of clamp 34 may be such as to require a slight spreading apart of the elements 40 to fit clamp 34 around block 12. In addition, the elements 40 are dimensioned such that the legs 37 fit snugly against the sides 26 of the block 12. Further, the dimensions are such that upon compressing the elements 40 as shown in FIG. 3 the block 12 may be easily slid along the stick 11 and upon releasing the elements 40 there is sufficient spring in the V-shaped portions 35, i.e., they are not completely relaxed, whereby portions 35 serve to urge the block 12 tightly against the stick 11.

The elements 40 in this example extend completely across terminal ends of associated legs 37 in a continuous uninterrupted manner. However, it will be appreciated that the elements 40 need not necessarily extend completely across as shown but may be discontinuous at their center portions, if desired.

The spring clamp 34 is made utilizing a suitable metallic material and may be made from a suitable rectilinear spring wire which is bent in the desired shape shown in FIG. 2 with the originally free opposite ends thereof disposed adjacent each other. Such free ends are then fixed as by welding to define a continuous uninterrupted saddle-like spring clamp.

Figure 3:
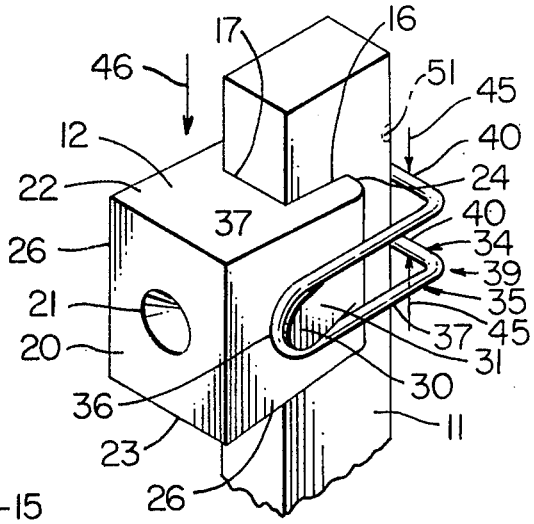
FIG. 3 is a perspective view similar to FIG. 1 illustrating the block and spring clamp being slid vertically downwardly along the upper portion of the stick by holding the spring clamp compressed to allow sliding.

The improved holding means of this invention may also comprise at least one notch in the stick 11 and in this example of the invention such a notch is illustrated by dotted lines 51 in FIG. 3. The notch 51 extends into the stick 11 and is defined by a semicylindrical surface which is particularly adapted to receive an associated interconnecting element 40 therewithin. The notch 51 and in particular the surface defining such a notch prevents movement of the interconnecting element 40 received therewithin and thus serves as a locking mechanism which prevents movement of spring clamp 34 and block 21 axially along the stick 11.

The projecting ears 30 provided on the block 12 and comprising the holding means 13 of this invention are preferably defined as an integral part of such block 12 during the process of forming same whereby the block 12 with ears 30 is a single-piece structure; however, it will be appreciated that such projecting ears 30 may be suitably fixed to the main portion of such block after forming thereof.

The block 12 is preferably made of a yieldable compressible, resilient, rubber-like material and the projecting ears 30 are made of similar or the same material. Accordingly, the ears 30 employ the resilient character of their material to yieldingly hold block 12 firmly against stick 11.

The block 12 may be made of any suitable material known in the art and materials which may be employed are a plurality of layers of rubber-faced fabric laminated together as a unitary structure, urethane elastomer, polyethylene, or any suitable synthetic plastic material.

While present exemplary embodiments of this invention, and methods of practicing the same, have been illustrated and described, it will be recognized that this invention may be otherwise variously embodied and practiced within the scope of the following claims.

What is claimed is:

1. In a loom picker construction having a picker stick, a shuttle-engaging block, and means holding said block on said stick; the improvement in said holding means comprising, a pair of projections extending from opposite sides of said block, and a spring clamp engaging said projections and stick and yieldingly urging said block against said stick, said spring clamp comprising a pair of similar roughly V-shaped portions each defined by a bight and a pair of diverging legs and each being disposed with its bight and legs in a common plane, with a pair of planes associated with the V-shaped portions being disposed in spaced approximately parallel relation and with the V-shaped portions symmetrically arranged.

2. A loom picker construction as set forth in claim 1 in which each of said pair of diverging legs of each V-shaped portion is interconnected by an arcuate bight.

3. A loom picker construction as set forth in claim 2 in which said arcuate bight is a substantially semi-circular bight.

4. A loom picker construction as set forth in claim 1 in which said projections extending from opposite sides of said block are defined as an integral part of said block.

5. A loom picker construction as set forth in claim 1 in which said V-shaped portions have extension means extending from the terminal ends of each pair of associated legs.

6. A loom picker construction as set forth in claim 5 in which said extension means extending from the terminal ends of each pair of associated legs comprises an element interconnecting said terminal ends of each pair of associated legs, said interconnecting elements being disposed in parallel relation and defining said spring clamp as a single-piece structure.

7. A loom picker construction as set forth in claim 6 in which said spring clamp is made of a metal spring wire and has an overall saddle-like appearance.

8. A loom picker construction as set forth in claim 7 in which each of said projections is in the form of a projecting ear having a planar outside surface and a substantially semicylindrical surface adapted to be engaged by a bight of an associated V-shaped wire portion.

9. A loom picker construction as set forth in claim 8 in which each side of said block is defined by a planar side surface and each ear has a planar outside surface disposed at an angle with said side surface so that the outside surface of each ear converges smoothly with its side surface when viewing said block from front to rear.

10. A loom picker construction as set forth in claim 6 wherein said holding means further comprises at least one notch defined in said stick for receiving an associated interconnecting element therewithin and thereby preventing movement of said element, spring clamp, and block axially along said stick.

11. A loom picker construction as set forth in claim 5 in which a dimension of said spring clamp measured from the ends of a bight perpendicular to an interconnecting element with the legs of said V-shaped portions compressed in parallel relation is greater than a corresponding dimension with the legs of said V-shaped portions only partially compressed whereby said clamp with said legs compressed in parallel relation is easily installed around said stick.

12. A loom picker construction as set forth in claim 11 in which said spring clamp is made of a wire of circular cross-sectional configuration.

13. A loom picker construction as set forth in claim 11 in which said projections of said holding means are made of a compressible resilient material which cooperates with said spring clamp to hold the block against said stick.

14. A loom picker construction comprising a picker stick of rectangular cross-sectional configuration, a shuttle-engaging block having a rear groove therein for receiving said stock therewithin, said block also having a pair of projections extending from opposite sides thereof, and a spring clamp engaging said projections and yieldingly urging said stick within said rear groove to hold said block against said stick; said spring clamp comprising a pair of similar roughly V-shaped portions each defined by a bight and a pair of diverging legs and each being disposed with its bight and legs in a common plane, with a pair of planes associated with the V-shaped portions being disposed in spaced approximately parallel relation and with the V-shaped portions symmetrically arranged.

15. A loom picker construction as set forth in claim 14 in which each of said pair of diverging legs of each V-shaped portion is interconnected by an arcuate bight and said arcuate bight is a substantially semicircular bight.

16. A loom picker construction as set forth in claim 15 in which said projections extending from opposite sides of said block are defined as an integral part of said block.

17. A loom picker construction as set forth in claim 16 in which said rear groove is defined by a pair of planar surfaces adjoined at their inner edges by a planar surface.

18. A loom picker construction as set forth in claim 17 in which said spring clamp is made of a metal wire of circular cross-sectional configuration and is formed in an endless path having a saddle-like configuration.

* * * * *